US005270725A

United States Patent [19]

Ursenbach et al.

[11] Patent Number: 5,270,725

[45] Date of Patent: Dec. 14, 1993

[54] ROTATING ANTENNA WITH WIRE DIPOLES

[75] Inventors: Francois Ursenbach, Eaubonne; Jean-Marc Martin, St. Leu La Foret, both of France

[73] Assignee: Thomson-CSF, Puteaux, France

[21] Appl. No.: 813,689

[22] Filed: Dec. 27, 1991

[30] Foreign Application Priority Data

Dec. 28, 1990 [FR] France ..... 90 16435

[51] Int. Cl.[5] ..... H01Q 3/02; H01Q 21/12

[52] U.S. Cl. ..... 343/813; 343/879; 343/882

[58] Field of Search ..... 343/812, 813, 814, 815, 343/817, 818, 879, 882, 878, 890, 891, 896, 757

[56] References Cited

U.S. PATENT DOCUMENTS

| | | | |
|---|---|---|---|
| 2,577,469 | 12/1951 | Kumpf | 343/813 |
| 2,586,276 | 2/1952 | Umstead | 343/815 |
| 3,165,817 | 1/1965 | Teague | 343/817 |

FOREIGN PATENT DOCUMENTS

| | | |
|---|---|---|
| 0002233 | 6/1979 | European Pat. Off. . |
| 3246917 | 7/1984 | Fed. Rep. of Germany . |
| 2591806 | 6/1987 | France . |

*Primary Examiner*—Michael C. Wimer

*Attorney, Agent, or Firm*—Oblon, Spivak, McClelland, Maier & Neustadt

[57] ABSTRACT

The antenna is a rotating dipole antenna comprising a base, a rigid support rotatably mounted on the base, a plurality of wire dipoles fixed to the support, and means to feed each dipole with electrical energy from a first end of said dipole. In order to provide for the efficient fastening of the dipoles, the rigid support extends before at least the first end of each dipole, and this first end is fixed directly to the rigid support while the second ends of the dipoles are either fixed directly to the rigid support or connected to it by a catenary supported on the support. The antenna can be applied to the designing of power antennas in the decametric wave range.

9 Claims, 2 Drawing Sheets

ROTATING ANTENNA WITH WIRE DIPOLES

BACKGROUND OF THE INVENTION

1. Field of the Invention

The invention relates to a rotating antenna that comprises a rigid support rotatably mounted on a base, a plurality of wire dipoles fixed to the support and means to feed each dipole with energy from a first end of this dipole. Hereinafter, and in the claims, the term "first end of the dipole" designates the feeding point of the dipole, namely the point at which the junction is made with the two-wire line that feeds it.

This is an antenna designed to radiate a substantial amount of power, for example 500 kW in the decametric wave range (3 to 30 MHz).

2. Discussion of the Background

There already exists a known antenna of this type, in which the rigid support essentially extends outside a zone in which the wire dipoles are positioned, the wire dipoles being connected to one another so as to form a curtain, the curtain being fixed by its ends to the rigid support by means of catenaries.

Although satisfactory, an antenna such as this has several drawbacks. Owing to the peripheral arrangement of the rigid support, its dimensions are substantially greater than those of the curtain of dipoles. This gives the antenna substantial bulk, which is greater than that dictated by its electrical operation. Besides, since the curtain of dipoles is maintained only by its edges, it gets substantially deformed under the effect of the wind, until the point where it comes into contact with the rigid support. Finally, it is difficult for maintenance staff to obtain access to the different points of the antenna since the curtain of dipoles cannot be used as a support for this purpose.

SUMMARY OF THE INVENTION

The problem that the invention seeks to resolve is to propose an antenna, of the type referred to at the beginning of this explanation, that does not have the above-mentioned drawbacks while at the same time limiting to the utmost the complexity of the rigid support and hence the cost of the antenna as a whole.

According to the present invention, there is provided a rotating dipole antenna comprising a base, a rigid support rotatably mounted on the base, n, where n is an integer greater than 0, wire dipoles fixed to the support, each dipole comprising a first and a second end, means to feed each dipole with electrical energy by its first end and catenaries supported on the support, wherein the rigid support extends before at least the first end of each dipole, wherein the first ends of the dipoles are fixed directly to the support and wherein the second ends of the dipoles are, in the case of some of them, fixed to the support and, in the case of others, connected to the support by the catenaries.

Thus, according to the invention, the rigid support is arranged so as to support each wire dipole at the place which it is most subjected to mechanical as well as electrical forces, namely at the above-mentioned first end, while its second end could be supported more summarily, by means of a catenary.

BRIEF DESCRIPTION OF THE DRAWINGS

Other details and advantages of the invention shall appear in the course of the following description of a non-restrictive example, made with respect to the appended drawings, of which.

MORE DETAILED DESCRIPTION

The rotating antenna shown in the figures is a double antenna comprising two arrays of dipoles and a set of switches to connect either of the two arrays to a feeder device of the antenna. Depending on the array connected, the antenna is a low range antenna Ab 4/4/0.5-6/7/9/11 MHz, or a high range antenna 4/4/1-13/15/17/21/26 MHz. It is recalled that, according to the international electrical definition of antennas, the designation 4/4/0.5-6/7/9/11 MHz, for example, corresponds to an antenna that is designed to work in the 6, 7, 9 and 11 MHz bands (which gives about half a wavelength of 18 meters at the center operating frequency of 8.47 MHz), and possesses four groups of four superimposed dipoles, the distance between two groups being equal to half a wavelength at the center frequency and the lowest group being at a distance from the ground equal to 0.5 times this wavelength. The power of the antenna is 500 kW.

The antenna has a vertical, metallic, central mast M possessing a reinforced concrete base M1, designed to rest on the ground. The base M1 has a circular flange M2 of substantial thickness on which there is positioned a tubular chamber M3. The flange M2 is partially buried in the ground S.

The tubular chamber M3 houses the ancillary circuits of the antennas. It is accessible to staff through a door M5.

The central mast M rests on the tubular chamber M3 by means of a ring gear M6 and a driving mechanism (not shown) can be used to make it rotate about a longitudinal axis of the mast.

Figure 1:
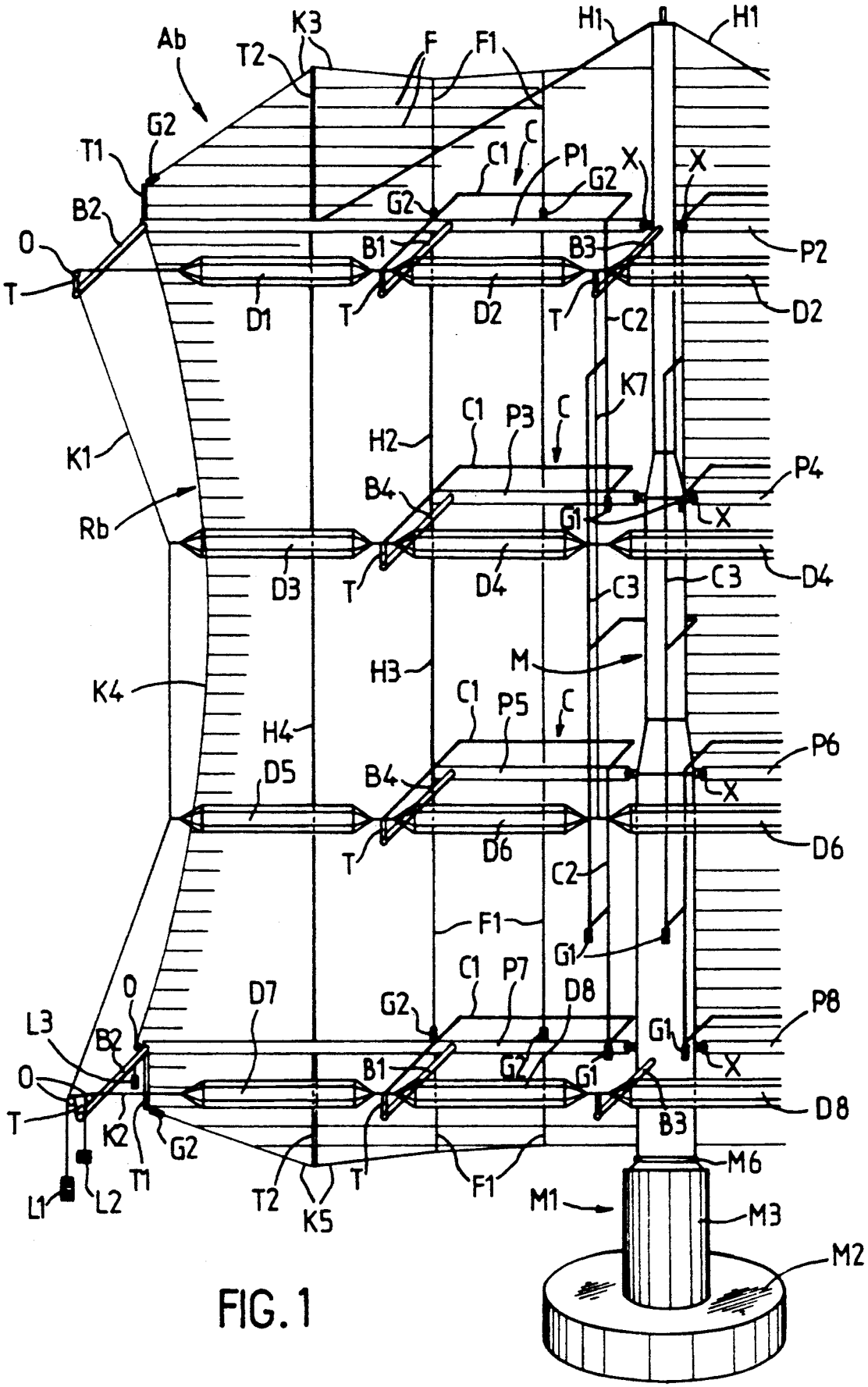
FIG. 1 shows a half-view in perspective of a first face of a rotating antenna according to the invention.

The low range antenna Ab includes four pairs of horizontal metal beams P1 to P8 positioned in the median longitudinal plane of the central mast M. Since each antenna is symmetrical with a plane perpendicular to the median longitudinal plane, the description of the half antenna shown in FIG. 1 is valid for the other half (not shown). The beams of each pair such as P1, P2 are arranged respectively on either side of the mast M and are fixed by an end to this mast by means of a hinge X so that they can pivot in the median longitudinal plane. The beams P1, P2, P7, P8 of two respectively higher and lower pairs of beams extend over about half the width of the antenna—i.e. a little more than half a wavelength at the center operating frequency of the dipoles borne by these beams, while the beams P3 to P6 of the pairs of intermediate beams, located between the preceding beams, extend over about a quarter of the width of the antenna, i.e. a little more than half a wavelength.

The upper beams P1, P2 are kept horizontal by means of a guy H1 inclined and fixed between an upper end of the central mast M and a region of the beams that is distant from their free end. The intermediate beams P3, P4 are supported by a vertical guy H2 fixed between a median region of the upper beams P1, P2 and a free end of the intermediate beams P3, P4. The intermediate beams P5, P6, positioned vertically to the previous ones, are supported by a vertical guy H3 connecting the free ends of the beams P3, P5 and P4, P6 respectively.

The lower beams P7, P8 are supported by a vertical guy H4 fixed between the corresponding upper beam P1, P2 (at the fastening point of the inclined guy H1) and a corresponding point of the lower beams P7, P8.

The beams P1, P2, P7, P8 of the upper and lower pairs of beams each bear two transversal arms B1, B2 respectively positioned in a median region of the beam and at a free end of this beam, and having a length substantially equal to a quarter of the wavelength, at the center operating frequency. Furthermore, another transversal arm B3 with a substantially equal length is fixed to the central mast M, between the beams of each of these pairs of beams.

Each beam P3 to P6 of the intermediate pairs of beams bears a single transversal arm B4 positioned in the vicinity of a free end of this beam and having a length identical to that of the arms borne by the upper and lower pairs of beams.

At a free end of each transversal arm B1 to B4, there is positioned a rod T extending upwards, parallel to the central mast M, on a length that is small compared with the length of the transversal arm. The rod T of the transversal arm B2 borne by the free end of each upper beam P1, P2 is fitted out, at a free end, with a pulley 0 with an axis parallel to the transversal arm while the corresponding rod of each lower beam P7, P8 is fitted out, at a free end, with two juxtaposed pulleys 0, positioned on either side of the rod T and having an axis parallel to the transversal arm B2. The free end of each lower beam P7, P8 also bears a pulley 0 with an axis parallel to the above axes.

Each upper beam P1, P2 also bears a rod T1 with a small length at its free end and a rod T2, the length of which is about a quarter of the wavelength at the center operating frequency, this rod being distant from the end of the beam; the two rods T1, T2 are pointed upwards. Each lower beam P7, P8, bears two similar rods T1, T2 that are pointed downwards.

The mast M, the beams P1–P8, the transversal arms B1–B4 and the rods T1, T2 are each constituted by a metal tube.

Between the transversal arms B1–B3 facing the upper beam P1, there are mounted two wire dipoles D1, D2 formed, in a known way, by a cylindrical cage of six conductive wires that are parallel to and distant from one another. One of these wire dipoles, D2, is fixed between the two free ends of the rods T borne by the transversal arms B1, B3, and the other dipole is fixed between the transversal arm B1 and the catenary K1, supported by the pulley O borne by the arm B2 and the pulley borne by the arm B2 of the lower beam P7; a weight L1 is fixed to a free end of the catenary K1 and places this catenary K1 and the dipole D1 under tension.

Two wire dipoles D7, D8 are mounted similarly before the lower beam P7, the dipole D7 being tautened by means of a catenary K2, supported on the other pulley O borne by the transversal arm B2 of this beam and a weight L2.

Facing the two pairs of intermediate beams P3, P4 and P5, P6, there are two pairs of wire dipoles D4, D4 and D6, D6, the dipoles of each pair being connected to each other by one end and being fixed, by their other end, to the tip of the rods T borne by the two transversal arms B4, B4 positioned on either side of the central mast M. The tautening of these dipoles is done indirectly by the catenary K1, it being known that the transversal arms are capable of getting slightly deformed. Besides, on each half of the antenna,, a wire dipole D3, D5 is fixed between the end of the rods T and the catenary K1 extending laterally along the antenna.

A catenary K7 is suspended at the free end of the upper transversal arm B3: to this catenary, there are fixed the ends of the dipoles D4 and D6 which are distant from the transversal arms B4.

Each of the dipoles D1 to D8 has a length that is slightly smaller than the center operating frequency, λ, namely 0.4λ, i.e. again about 14 m.

The dipoles are fed in pairs by means of a two-wire feeder line. Thus, the four pairs of dipoles D1–2, D3–4, D5–D6 and D7–D8 located on the half antenna of FIG. 1 are fed by four feeder lines C shown schematically in this FIGURE. The fastening means of these feeder lines shall be specified further below in the description of FIGS. 2 and 3.

Each feeder line C starts from the end of the transversal arm B1–B4 supporting the pair of dipoles, goes along this arm and then along the corresponding beam P1, P3, P5, P7 until it meets the central mast M and goes along it to reach the tubular chamber M3. Supply line portions extending vertically are placed under tension by means of helical springs G1 positioned vertically beneath these feeder line portions.

A reflector Rb extends on substantially the entire surface of the low range antenna Ab. It has two parts that are positioned on either side of the central mast M and are constituted by a layer of horizontal conductive wires F that are spaced out from each other at a distance of about 1 m. The wires F are fixed at one end to the central mast M by a conductive link and are fixed, at their end, other to a catenary such as K2–K5 or, in the case of some of them, to the rods T1, borne by the upper beam P1 and lower beam P7. The catenaries K3, K5 extend between the end of the rods T1 and the central mast M in being supported on the longer rods T2, borne by the upper and lower beams, while the catenary K4 extends between the free ends of these beams. The catenaries K3, K5 are connected to the rods T1 by a helical draw-spring G2. The catenary K4 is fixed to the upper beam P1 by one end and bears a weight L3 at its other end, this end being supported on the pulley O of the lower beam P7.

Between its two ends, each wire F of the reflector Rb is fixed at several points at which it crosses either a rod such as T2 or a guy such as H1–H4, or again vertical conductive wires F1. The vertical wires F1 extending between the catenary K3 and the upper beam P1, on the one hand, and between the upper beam P1 and the lower beam P7, on the other hand, are tautened by a helical spring G2 fixed between their lower end and the neighboring beam.

It has been observed that the discontinuity created by the presence of the central mast M in the reflector Rb does not substantially modify its behavior at the frequencies concerned.

The groups of dipoles D1–D8 are fixed at the following four heights in relation to the ground: 17.7 m; 35.4 m; 53.1 m; 70.9 m. As for the ring gear M6, it is located as closely as possible below the reflector Rb, namely at a height of slightly more than 8 m. Finally, the central mast M rises to a height of about 80 m and barely goes beyond the reflector Rb, which itself extends over a height equal to 0.25λ, at the center operating frequency, above the highest dipoles D1, D2.

Figure 2:
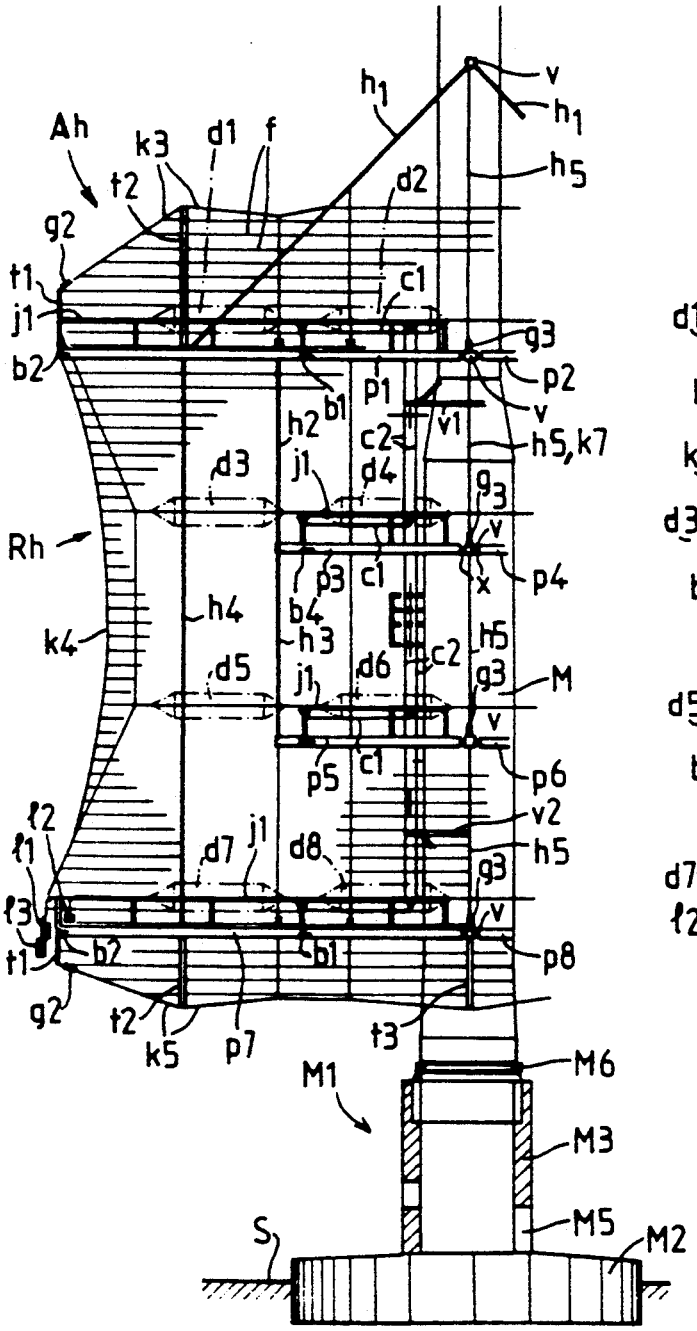
FIG. 2 shows a half-view showing a second face of the antenna.
Figure 3:
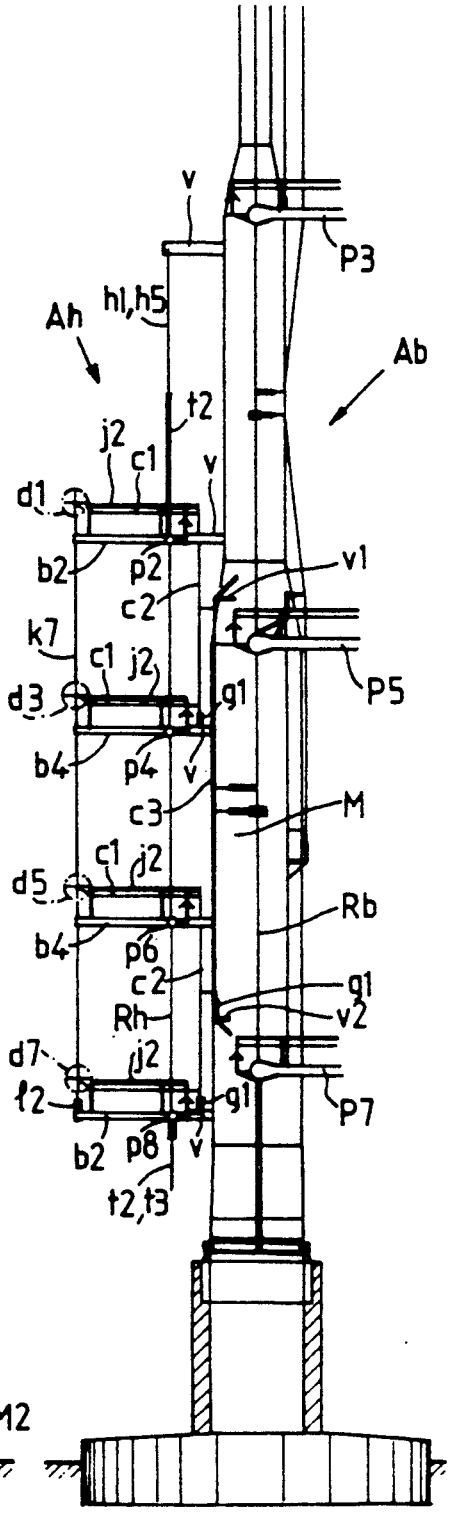
FIG. 3 shows a partial side view of the antenna.

The high range antenna Ah shown in FIGS. 2 and 3 is similar to the low range antenna Ab, and the description relating to this antenna Ab can be applied to it, the corresponding elements being referenced by lower-case letters. Naturally, its dimensions match the center frequency at which it works, so that its dipoles d1 to d8, having a length equal to about 7 m, are positioned at the following four heights in relation to the ground: 15.9 m; 23.9 m; 31.8 m; 39.8 m.

The high range antenna Ah is distinguished, however, by the fact that its reflector Rh is not located in a median longitudinal plane of the central mast M but is offset from it so that its wires f extend continuously from one lateral catenary k4 to the other. The beams p1 to p8, which are again located in the plane of the reflector Rh, are therefore fixed in a pivoting position not directly on the central mast M, but on bars v that are transversal both to the reflector Rh and to the central mast M and are rigidly fixed to this central mast M. In the same way, the guys h1 are fixed to a bar v such as this. These transversal bars v are all connected to one another by guys h5, each guy being fixed between the free ends of two adjacent bars v with the interposition of a helical draw-spring g3.

Furthermore, a rod t3 is fixed to the free end of the lowest transversal bar v and extends vertically downwards so as to keep the wires of the reflector Rh in this region.

Along and above each beam P1–P8 of the high range antenna and each beam p1–p8 of the low range antenna, there is fixed a guard-rail j1 (FIG. 2) enabling easy access by the maintenance staff to the different points of the antenna. A guard-rail j2 (FIG. 3) is also fixed along each transversal arm b1–b4 or B1–B4.

The feeder lines of the dipoles comprise:—a horizontal line portion c1 (and C1 respectively for the low range antenna) extending along a part of each guard-rail j1 and each guard-rail j2, to feed two adjacent dipoles such as d1, d2;—a first vertical line portion c2, C2 grouping together the feeder system for two groups of two superimposed dipoles d1,d2 and d3,d4;—a second vertical line portion c3, C3 connecting two first portions c2, C2; - and a third vertical line portion positioned within the central mast M and bringing together all the feeder lines of each antenna.

Each first vertical line portion c2 is tautened between the guard-rail j1 of a beam p1, located above, and the beam p3 located below, the connection with this beam p3 being made by a helical draw-spring g1 (FIG. 3). Each second portion of a vertical line c3 is fixed between two horizontal bars v1, v2, fixed at two regions of the central mast M that are distant from each other, again with the interposition of a helical draw-spring g1.

Several advantages result from the above-mentioned structure. The presence of a metal support extending over the width and the height of the antenna gives it great rigidity that enables it to withstand fairly substantial stresses due to wind or frost. This support is constituted by all the beams P1 to P8 and all the transversal arms B1–B4. The dipoles D1–D8 are directly connected, at several points, to this support; this means that these dipoles are properly supported and prevents them, notably, from coming into contact with the reflector Rb. Each reflector Rb, Rh also derives direct benefit from the rigidity of the support, since several of the elements that hold it (rods T1, T2; vertical wires F1; guys H1–H4) are fixed to this support. The feeder lines themselves, C1–C4, are supported on this support in their horizontal portions or are tautened between two points of this support in their vertical portions whereas, in the prior art, they had to be held by specific and very long catenaries meeting the peripheral hooking points of the antenna.

This support further makes it possible to easily reach the different points of the antenna for maintenance purposes, notably at the end of the transversal arms along which the feeder lines extend.

It will also be noted that this support does not extend substantially beyond the dimensions dictated by the electrical specifications of the antenna, i.e. beyond the dimensions of the low range reflector Rb. This is due firstly to the original way in which the dipoles are tautened: whereas, in the prior art, the dipoles were tautened from points located far outside the antenna, in the present invention they are now tautened from pulleys O located in the surface of the reflector Rb. This reduces the value of the forces to be applied to the lateral catenaries K1. The above-mentioned feature is due, secondly, to the fact that the main stiffening elements, namely the beams P1–P8, are interposed at the very core of the reflector whereas, in the prior art, the stiffening elements were located outside the boundaries of the reflector.

Furthermore, the particular structure of the base M1 makes it possible to place a substantial part of the volume of reinforced concrete in as high a position as possible so as to support the central mast M more efficiently and reduce the volume of buried concrete, and, at the same time, makes it possible to obtain the advantage of a machine room whereas, in the prior art, the major part of the volume of concrete was located in the flange M2.

What is claimed is:

1. A rotating dipole antenna comprising:
- a base;
- a rigid support rotatably mounted on the base;
- a plurality of pairs of horizontal beams positioned in a predetermined plane and being fixed to the rigid support;
- a first plurality of transverse arms fixed to the horizontal beams;
- a second plurality of transverse arms fixed to the rigid support;
- a plurality of wire dipoles, each wire dipole having a first inner end and a second outer end;
- means for feeding each of the wire dipoles with electrical energy at the first inner ends of each of the wire dipoles;
- a first mounting means for mounting each of the wire dipoles at their first inner ends to a respective one transverse arm of the first plurality of transverse arms;
- a second mounting means for mounting first selected ones of the wire dipoles at their second outer ends to a respective one transverse arm of the second plurality of transverse arms; and
- a first catenary for connecting second selected ones of the wire dipoles at their second outer ends to a selected one of the second plurality of transverse arms the rigid support.

2. The rotating dipole antenna according to claim 1, wherein the rigid support comprises a vertical mast and the horizontal beams of each pair of horizontal beams are positioned so that one horizontal beam of each pair of horizontal beams is located on each side of a median longitudinal plane of the mast.

3. The rotating dipole antenna according to claim 1, wherein the first and second mounting means comprise a rod.

4. The rotating dipole antenna according to claim 1, wherein the means for feeding the wire dipoles with electrical energy comprises feeder lines which extend along the horizontal beams and the first plurality of transverse arms to connect with the first ends of the wire dipoles.

5. The rotating dipole antenna according to claim 1, wherein the second plurality of transverse arms are located to be mounted with a topmost and bottommost wire dipole.

6. The rotating dipole antenna according to claim 4, wherein the second plurality of transverse arms are located to be mounted with a topmost and bottommost wire dipole.

7. The rotating dipole antenna according to claim 1, further comprising a third plurality of transverse arms fixed to an outside of a topmost and bottommost horizontal beam.

8. The rotating dipole antenna according to claim 4, further comprising a third plurality of transverse arms fixed to an outside of a topmost and bottommost horizontal beam.

9. The rotating dipole antenna according to claim 5, further comprising a third plurality of transverse arms fixed to an outside of a topmost and bottommost horizontal beam.

* * * * *